US006711537B1

(12) United States Patent
Beaucoup

(10) Patent No.: US 6,711,537 B1
(45) Date of Patent: Mar. 23, 2004

(54) COMFORT NOISE GENERATION FOR OPEN DISCONTINUOUS TRANSMISSION SYSTEMS

(75) Inventor: Franck Beaucoup, Dunrobin (CA)

(73) Assignee: Zarlink Semiconductor Inc., Kanata (CA)

( * ) Notice: Subject to any disclaimer, the term of this patent is extended or adjusted under 35 U.S.C. 154(b) by 433 days.

(21) Appl. No.: 09/717,421

(22) Filed: Nov. 21, 2000

(30) Foreign Application Priority Data

Nov. 22, 1999 (GB) ..... 9927595

(51) Int. Cl.[7] ..... G10L 19/04
(52) U.S. Cl. ..... 704/220; 704/219
(58) Field of Search ..... 704/200, 201, 704/205, 206, 207, 208, 209, 210–221, 261–268, 228

(56) References Cited

U.S. PATENT DOCUMENTS

| | | | | |
|---|---|---|---|---|
| 5,537,509 A | * | 7/1996 | Swaminathan et al. | 704/228 |
| 5,630,016 A | | 5/1997 | Swaminathan et al. | |
| 5,794,199 A | * | 8/1998 | Rao et al. | 704/258 |
| 5,812,965 A | * | 9/1998 | Massaloux | 704/205 |
| 5,960,389 A | | 9/1999 | Jarvinen et al. | |
| 6,535,844 B1 | * | 3/2003 | Wood et al. | 704/210 |

FOREIGN PATENT DOCUMENTS

| | | |
|---|---|---|
| EP | 0657872 | 12/1994 |
| EP | 0751490 | 1/1997 |
| EP | 0869476 | 10/1998 |
| GB | 2256997 | 12/1992 |
| GB | 2285204 | 6/1995 |
| GB | 2332347 | 6/1999 |
| WO | WO0122710 | 3/2001 |

OTHER PUBLICATIONS

Search Report of Great Britain Application No. 9927595.0.

* cited by examiner

*Primary Examiner*—Richemond Dorvil
*Assistant Examiner*—Abul K. Azad
(74) *Attorney, Agent, or Firm*—F. Chau & Associates, LLC

(57) ABSTRACT

A Comfort Noise Generation (CNG) system is provided for use in open systems where there is no predefined protocol for transmission of Silence Insertion Descriptor (SID) information from transmitter to receiver. The receiver enters an underrun condition in response to periods of silence, and in response generates comfort noise. According to the present invention, the computation of the level and spectral characteristics of the background of the speech signal is done within the receiver, thereby overcoming the lack of a protocol to transmit the SID information during silence periods. These characteristics are computed as a gain parameter and a set of Linear Prediction Coding (LPC) parameters which are applied to a filter which filters flat-spectrum noise in order to generate noise that sounds like the background noise of the speech signal.

5 Claims, 4 Drawing Sheets

COMFORT NOISE GENERATION FOR OPEN DISCONTINUOUS TRANSMISSION SYSTEMS

FIELD OF THE INVENTION

This invention relates in general to communication systems having a transmitter and a receiver, and more specifically to an apparatus and method for generating comfort noise in an open system where there is no defined protocol between the transmitter and receiver.

BACKGROUND OF THE INVENTION

In asynchronous voice communication systems, it is possible to take advantage of the silence periods in a speech signal to reduce the amount of data sent from a transmitter to a receiver. For example, Discontinuous Transmission (DTX) systems are known whereby the transmitter sends a minimal amount of information during the silence periods rather than continuously transmitting the actual background noise. This Silence Insertion Descriptor (SID) information describes the spectral and level characteristics of the background noise not sent by the transmitter. The receiver uses this SID information to regenerate the background noise (this is known in the art as Comfort Noise Generation (CNG)). Many such CNG schemes have been described and implemented with success. However, all such systems require the transmitter and receiver to use a predefined protocol for exchanging the SID information (i.e. they are "closed systems").

The following are examples of such prior art systems:

[1] ITU, G.723.1 Annex A, Silence Compression Scheme

[2] ITU, G.729 Annex B, Silence Compression Scheme

[3] ITU R M. 1073-1, Digital cellular land mobile telecommunication systems, annex 2: General description of the GSM system

[4] U.S. Pat. No. 5,960,389, Methods for generating comfort noise during discontinuous transmission

[5] U.S. Pat. No. 5,630,016, Comfort noise generation for digital communication systems

[6] U.S. Pat. No. 5,537,509, Comfort noise generation for digital communication systems

[7] U.S. Pat. No. 5,794,199, Method and System for improved discontinuous speech transmission In the case of "open systems" where there is no such protocol, the transmitter simply stops transmitting during silence periods. The receiver then enters an underrun condition. A few straightforward schemes have been implemented in prior art "open systems" in order to avoid such an underrun condition during transmitter silence periods. These schemes include playing out zeros at the receiver, playing out white or coloured noise at a fixed level, as well as estimating the level of the background noise (for instance with the level of the last frame received) and playing out fixed white or coloured noise at that level. It is well know in the art that these schemes result in noticeable transitions between the background noise of the signal being transmitted and the comfort noise generated by the receiver. These artefacts greatly affect the overall speech quality. In order to achieve good speech quality, the generated comfort noise has to be of substantially the same level and spectral characteristics as the background noise of the speech signal.

SUMMARY OF THE INVENTION

According to the present invention, a Comfort Noise Generation (CNG) system is provided for use in "open systems" where there is no predefined protocol for transmission of SID information from the transmitter to the receiver. As discussed above, in such systems, the transmitter simply stops transmitting during silence periods. The receiver then enters an underrun condition and generates comfort noise with the least possible impact on the overall speech quality. More particularly, according to the present invention, the computation of the level and spectral characteristics of the background of the speech signal is done within the receiver, thereby overcoming the lack of a protocol to transmit the SID information during silence periods. These characteristics are computed as a gain parameter and a set of Linear Prediction Coding (LPC) parameters which are applied to a filter which filters flat-spectrum noise in order to generate noise that sounds like the background noise of the speech signal.

BRIEF DESCRIPTION OF THE DRAWINGS

Embodiments of the present invention are hereinafter described with reference to the following drawings in which.

DETAILED DESCRIPTION OF THE PREFERRED EMBODIMENT

Figure 1:
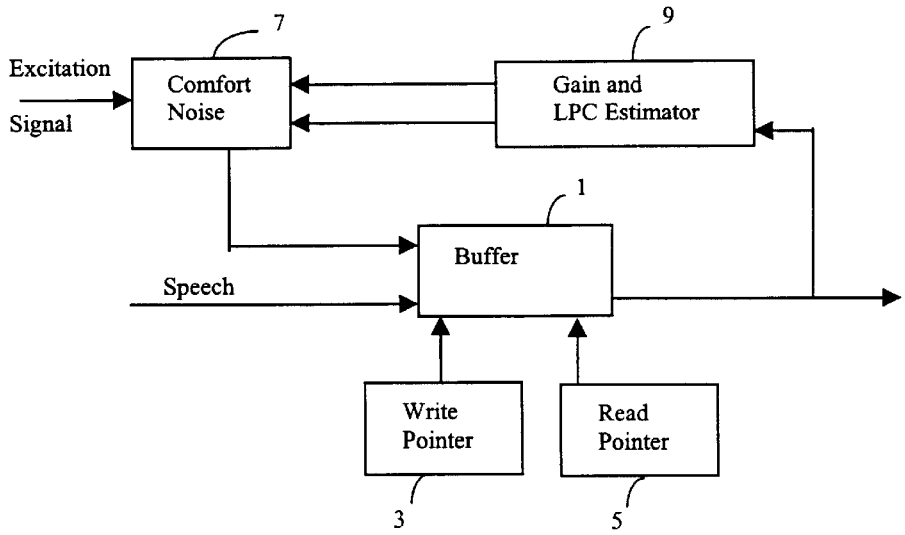
FIG. 1 is a block diagram of a comfort noise generation system according to the present invention.

With reference to FIG. 1, a circular buffer 1 is shown in a receiver for storing packets of speech received from a transmitter and subsequently reading out the speech at a constant data rate for transmission to a digital telephone (not shown). The speech signal is transmitted in frames over the transmission channel. The exact size of the frame is not critical to the invention, but could be, for example, 10 ms as set forth in G.729, 30 ms as set forth in G.723.1, or any other frame size. An example of such a circular buffer is set forth in co-pending commonly-assigned Application Mitel #398. The buffer is large enough to contain several packets of voice data (e.g. typically of sufficient size to store approximately 0.5 seconds of voice). Data packets containing voice samples are written into the circular buffer 1 at the addresses pointed to by write pointer 3, as they are received. TDM data is read out of the buffer 1, sample by sample, from the location pointed to by the TDM sample pointer 5. This pointer is incremented after each sample is read. The method by which packets are written to the buffer (1) and TDM voice samples are read from the buffer does not form part of the present invention. However, a preferred method is set forth in co-pending commonly-assigned Application Mitel #398, referred to herein above.

As discussed above, when implemented in an open system, no predefined protocol is provided for transmission of SID information, as contrasted with prior art DTX systems. Therefore, according to the present invention, the receiver includes a comfort noise generator 7 and a signal gain and LPC estimator 9 for estimating gain factor and LPC parameters for generation of silence noise via comfort noise generator.

Figure 2:
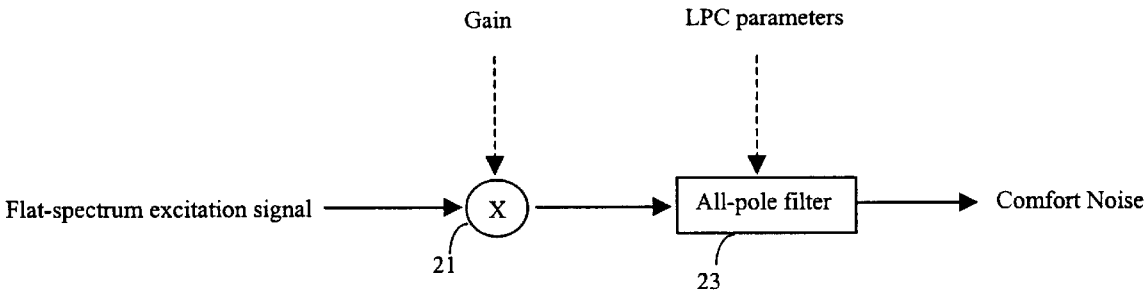
FIG. 2 is a diagrammatic representation of a filter block used in the comfort noise generation system of the present invention.

The comfort noise generator block 7 is shown in greater detail with reference to FIG. 2, comprising a multiplier 21 and an all-pole filter 23. As discussed briefly above, and in greater detail with reference to the published prior art, the gain parameter and Linear Prediction Coding (LPC) parameters are applied to multiplier 21 and filter 23, respectively, to filter flat-spectrum noise into the desired background noise of the speech signal.

Figure 3:
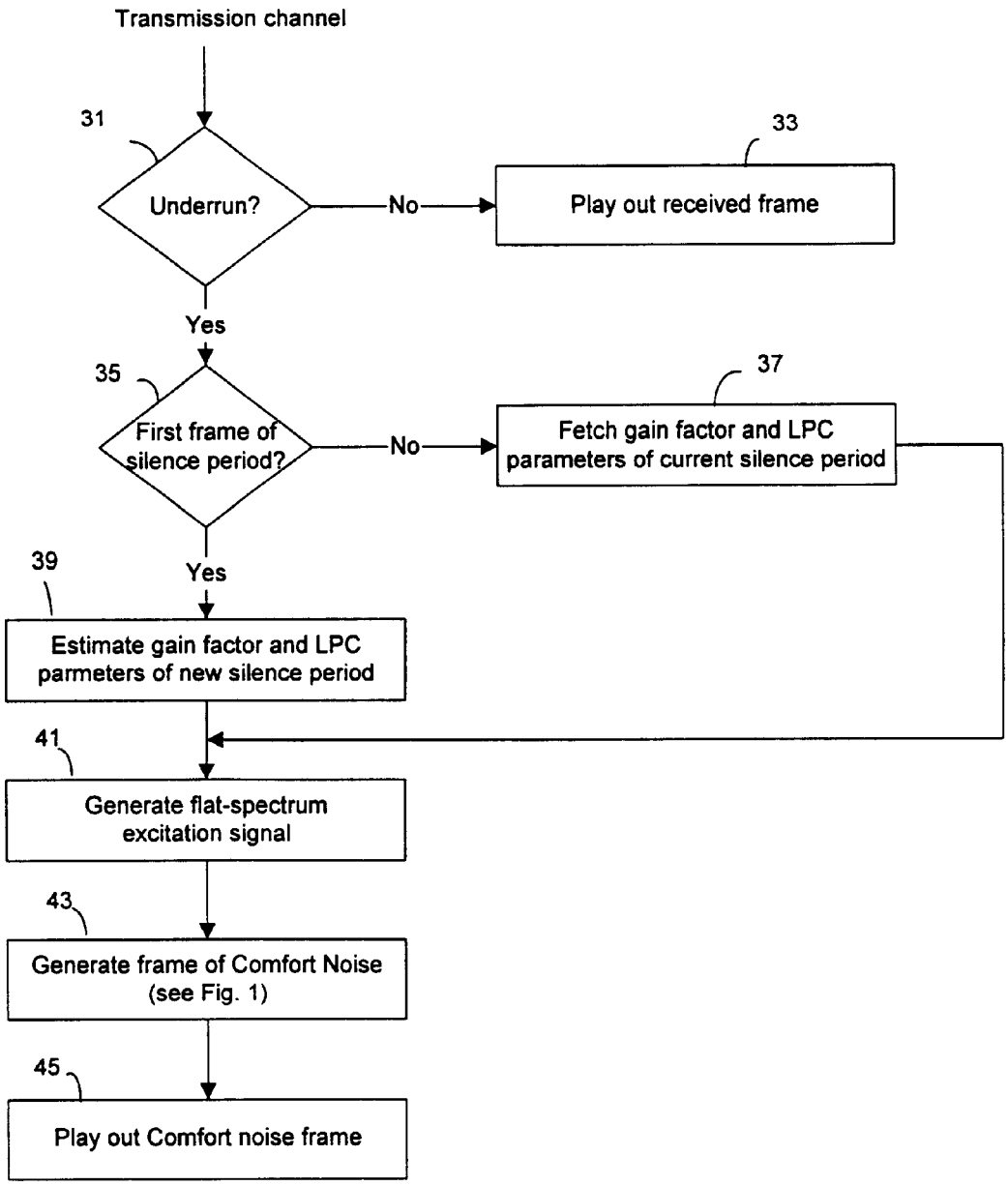
FIG. 3 is a flowchart showing operation of the comfort noise generation system of the invention.

A high-level operational flowchart for the invention is set forth in FIG. 3. In the event that buffer 1 contains voice packets to transmit (step 31), the frame of packets is played out of the buffer in the usual manner (step 33). However, in the event buffer 1 enters an underrun condition, silence is detected and, for the first frame of silence (step 35), the signal gain and LPC parameters are estimated (step 39). For subsequent frames of the buffer underrun condition, the previously computed gain and LPC parameters are used to generate comfort noise within the receiver (step 37).

Figure 4:
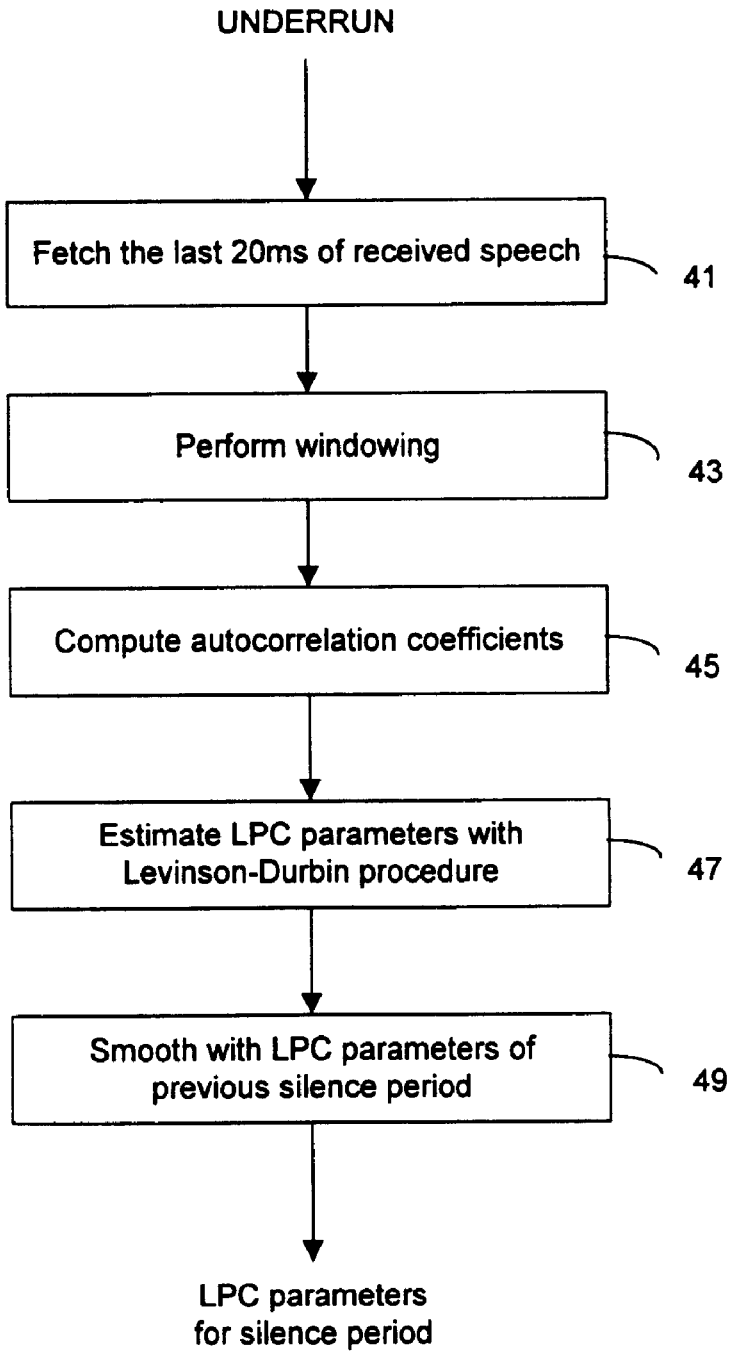
FIG. 4 is a flowchart showing details of an LPC parameter calculation step in FIG. 3.

Turning briefly to FIG. 4, the LPC coefficient parameters estimation procedure is shown according to the preferred embodiment. Because most algorithms for silence detection require a minimum period of silence before triggering a silence state, the LPC parameters of the background noise can be estimated from the last approximately 20ms of speech received prior to the underrun condition (step 41). Any classical method of windowing (step 43) may be used prior to the calculation of the autocorrelation coefficients of the speech samples (step 45). According to the preferred embodiment, the well-known Levinson-Durbin procedure is used (step 47) to estimate the LPC parameters, similar to classical LPC-based vocoders (as set forth in references [1], [2] and [3], above). In order to increase the stability of the LPC estimation, it is contemplated that the estimated LPC coefficients may be averaged with those of the previous silence periods (step 49). This, however, may result in some loss in tracking ability in the event of variations in the background noise of the speech signal between consecutive silence periods.

It is known in the art that a minimum of ten LPC parameters is necessary to represent a reasonably wide range of spectral characteristics of the background noise. In the present invention, because the LPC parameters are estimated within the receiver instead of being transmitted over the transmission channel, more LPC parameters are preferably used in order to be able to better represent the spectral shapes of the background noise. Because the calculations are performed within the receiver, there is no impact on the bandwidth used for voice transmission. The only impact is on the complexity of the algorithm, both in terms of LPC analysis (i.e. estimation of the LPC parameters) and all-pole filtering (filter 23 in FIG. 2). It has been discovered that using twenty parameters instead of ten results in a substantial improvement in the quality of the generated background noise. The complexity of the algorithm is roughly doubled as a result of doubling the number of LPC parameters used, as discussed in greater detail.

Returning to FIG. 3, a similar methodology is used to estimate the gain of the voice signal (step 39). Specifically, the gain factor is first estimated on the basis of the last approximately 20 ms of received speech, and then smoothed using the gain factor of the previous silence periods. The initial gain estimation (prior to smoothing) is derived from the LPC coefficients and the autocorrelation coefficients via the Wiener-Hopf equations, as set forth in references [2] and [8] above.

The flat-spectrum excitation signal is generated utilizing any technique used in conventional DTX systems (step 41). Thus, the excitation signal may be in the form of pure white noise generated via a pseudo-random number generator, or any mixture between pure white noise, adaptive excitation and CELP fixed excitation as described in reference [2]. The excitation signal is then used to generate frames of comfort noise (step 43), as described in FIG. 2, which are then played out of the buffer (step 45).

Returning to the issue of algorithm complexity, with M LPC coefficients and N last received samples of the speech signal (M=20 and N=160 in the description above), the estimation of gain factor and LPC parameters for the whole silence period takes N instructions for windowing, M×N instructions for generation of the autocorrelation coefficients and $O(M^2)$ (more precisely approximately $10\times M^2$) for the Levinson-Durbin procedure and derivation of the gain factor. Generation of the flat-spectrum excitation signal takes approximately 5 instructions per sample to output, and the all-pole filtering and gain factor require on the order of M instructions per sample to output. Thus, the total cycle count for M=20 and N=160 is less than 10,000 instructions to compute the gain factor and LPC parameters for the whole silence period, and then approximately 25 to 30 instructions per sample to output.

Figure 5:
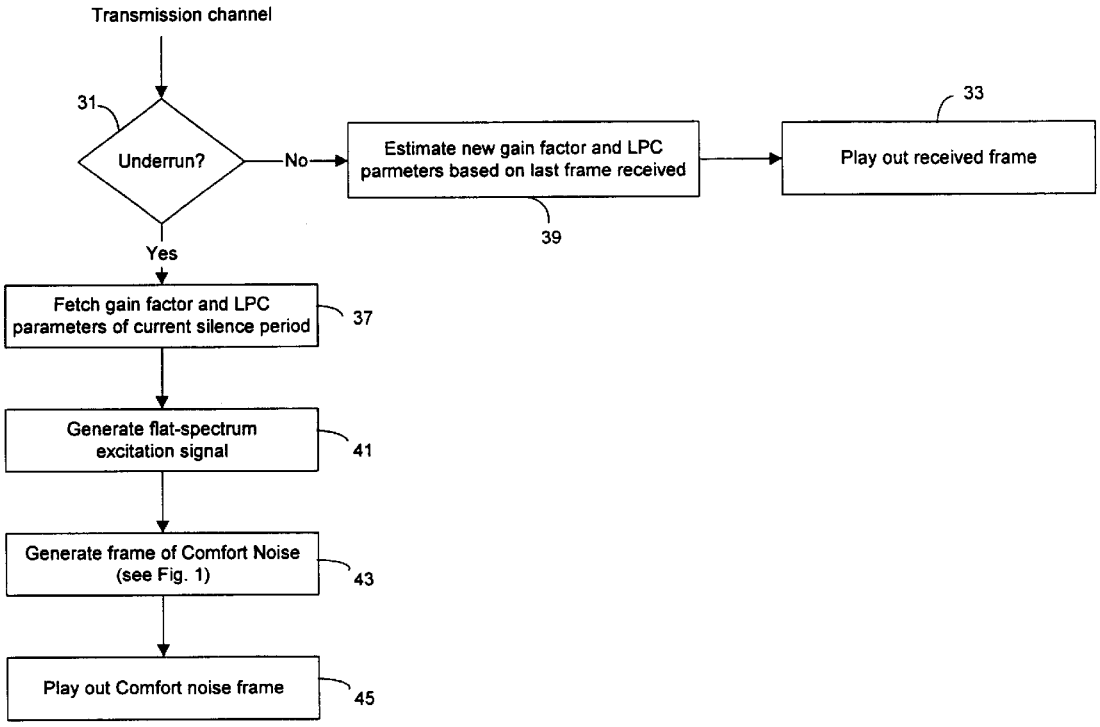
FIG. 5 is a flowchart showing operation of the comfort noise generation system according to an alternative embodiment of the invention.

According to the alternative embodiment of FIG. 5, where like reference numerals denote identical steps in the embodiment of FIG. 3, the peaks of complexity arising at the beginning of each silence period are averaged out. Thus, the LPC parameters and gain factor for each new frame of 20 ms are estimated based on each previously received (i.e. last) frame. In the event that the "last frame" turns out to be immediately before a silence period, then the previously estimated parameters are used for the generation of comfort noise during the entire silence period. Thus, the worst-case complexity for active frames is less than 10,000 instructions per 20 ms (i.e. less than 0.5 MIPS), and the complexity for silence periods becomes approximately 30 instructions per sample (i.e. approximately 0.25 MIPS).

It will be appreciated that, although a particular embodiment of the invention has been described and illustrated in detail, various changes and modifications may be made. For example, alternate methods may be used to compute and smooth the LPC coefficients, or to generate the flat-spectrum excitation signal. Indeed, as explained in reference [4] flat-spectrum white noise may not be the best candidate for the excitation signal of the computed LPC parameters to generate the comfort noise. Instead, a random excitation signal may be generated and modified by a spectral control filter. The principles of the present invention may also be applied to any application where DTX is used in a "closed system" where no protocol is defined for transmission of the SID information.

All such variations are believed to be within the sphere and scope of the invention as defined by the claims appended hereto.

What is claimed is:

1. For use in a discontinuous transmission (DTX) system having a transmitter and a receiver, wherein the transmitter ceases transmitting during periods of silence between frames of speech samples, a method implemented entirely within said received and independently of any communication protocol between said transmitter and said receiver for generating conform noise only during said periods of silence, comprising the steps of:

A) detecting a first frame of each of said periods of silence and response (i) estimating a gain factor for generation of comfort noise and (ii) estimating LPC parameters for generation of said comfort noise;

B) generating an excitation signal;

C) applying said gain factor and said LPC parameters to said excitation signal for generating a frame of said comfort noise;

D) playing out said frame of comfort noise; and

E) detecting further frames of said periods of silence and in response retrieving said gain factor and LPC parameters and performing steps B) and D);

wherein said LPC parameters are estimated by:

receiving approximately 20 ms of speech samples prior to said period of silence;

performing a windowing operation on said speech samples;

computing autocorrelation coefficients of the windows speech samples;

applying Levinson-Durbin procedure to estimate LPC coefficients; and averaging the estimated LPC coefficients over successive silence periods to generate said LPC parameters.

2. The method of claim 1, wherein said gain factor is estimated by:

receiving approximately 20 ms of speech samples prior to said period of silence;

applying Wiener-Hopf equations of said LPC coefficients and said autocorrelation coefficients for deriving an estimated gain parameter; and averaging the estimated gain parameter over successive silence periods, to generate said gain factor.

3. The method of claim 1, wherein said generated excitation signal is a flat-spectrum excitation signal.

4. The method of claim 1, wherein said generated excitation signal is pure white noise generated via a pseudo-random number generator.

5. For use in a discontinuous transmission (DTX) system having a transmitter a receiver, wherein the transmitter ceases transmitting during periods of silence between frames of speech samples, a method implemented entirely within said receiver and independently of any communication protocol between said transmitter and said receiver for generating comfort noise only during said periods of silence, comprising the steps of:

A) estimated a gain factor and LPC parameters during each frame of speech samples;

B) detecting said periods of silence, and in response;

C) retrieving said gain factor and LPC parameters;

D) generating an excitation signal;

E) applying said gain factor and said LPC parameters to said excitation signal for generating a frame of said comfort noise;

F) playing out said frame of comfort noise;

wherein said LPC parameters are estimated by:

receiving approximately 20 ms of speech samples prior to said period of silence;

performing a windowing operation on said speech samples;

computing autocorrelation coefficients of the windows speech samples;

applying Levinson-Durbin procedure to estimate LPC coefficients; and averaging the estimated LPC coefficients over successive silence periods to generate said LPC parameters.

* * * * *